US010794005B2

(12) United States Patent
Pearson et al.

(10) Patent No.: US 10,794,005 B2
(45) Date of Patent: Oct. 6, 2020

(54) PAPER INCLUDING ONE OR MORE MULTI-TONAL WATERMARKS HAVING FULL TONALITY, AND AN IMPROVED WATERMARKING TOOL FOR MANUFACTURING SUCH PAPER

(71) Applicant: Crane & Co., Inc., Boston, MA (US)

(72) Inventors: Nicholas G. Pearson, Amherst, NH (US); Giles D. Prett, Dalton, MA (US)

(73) Assignee: Crane & Co., Inc., Boston, MA (US)

( * ) Notice: Subject to any disclaimer, the term of this patent is extended or adjusted under 35 U.S.C. 154(b) by 138 days.

(21) Appl. No.: 15/905,657

(22) Filed: Feb. 26, 2018

(65) Prior Publication Data

US 2018/0258588 A1 Sep. 13, 2018

Related U.S. Application Data

(60) Provisional application No. 62/464,011, filed on Feb. 27, 2017.

(51) Int. Cl.
*D21F 1/44* (2006.01)
*D21F 11/00* (2006.01)
(Continued)

(52) U.S. Cl.
CPC ..... *D21F 1/44* (2013.01); *B42D 25/333* (2014.10); *B42D 25/425* (2014.10); *D21F 1/105* (2013.01);
(Continued)

(58) Field of Classification Search
CPC . D21F 1/44; D21F 1/46; D21F 1/0027; D21F 1/0036; D21F 1/009; D21F 1/10;
(Continued)

(56) References Cited

U.S. PATENT DOCUMENTS 1,901,049 A 3/1933 von Heinrich
2,009,185 A 7/1935 McCorkindale
(Continued)

FOREIGN PATENT DOCUMENTS

DE 102005042344 A1 3/2007
EP 1122360 A1 8/2001
(Continued)

OTHER PUBLICATIONS

WO 2007/028485, English language machine translation [epo.org]. (Year: 2007).*
(Continued)

*Primary Examiner* — Eric Hug

(57) ABSTRACT

A paper including one or more multi-tonal watermarks having full tonality (depth), and an improved watermarking tool for manufacturing such paper, is provided. The improved watermarking tool is selected from the group of: (a) an assembly that is made up of an electrotype element representing a halftone image of a watermark, and a wire-mesh for use in the manufacture of watermarked paper, wherein the electrotype element is affixed to the wire-mesh, and wherein the electrotype element and the wire-mesh are pressed or embossed, either separately or together in register, with the image of the watermark represented by the electrotype element; and (b) an enhanced wire-mesh made up of woven wires which may be arranged in a regular or substantially regular grid, wherein areas of the grid are filled with a polymeric material which forms regions of blocked drainage, wherein the wire-mesh including open areas as well as those areas filled with the polymeric material are pressed or embossed either separately or together with an image of a watermark.

20 Claims, 6 Drawing Sheets

(51) Int. Cl.

| | |
|---|---|
| ***D21H 27/02*** | (2006.01) |
| ***B42D 25/30*** | (2014.01) |
| ***B42D 25/333*** | (2014.01) |
| ***B42D 25/425*** | (2014.01) |
| ***D21F 1/10*** | (2006.01) |
| *B42D 25/324* | (2014.01) |

(52) U.S. Cl.
CPC ..... *D21H 27/02* (2013.01); *B42D 25/324* (2014.10); *D21F 11/006* (2013.01)

(58) Field of Classification Search
CPC ..... D21F 1/105; D21F 11/006; D21H 27/02; D21H 27/04; B41M 3/10; B42D 25/324; B42D 25/333; B42D 25/425
USPC ..... 162/352
See application file for complete search history.

(56) References Cited

U.S. PATENT DOCUMENTS

| | | | | |
|---|---|---|---|---|
| 5,275,870 | A | 1/1994 | Halope et al. | |
| 5,486,928 | A | 1/1996 | Doublet et al. | |
| 6,991,846 | B2 | 1/2006 | Mallol et al. | |
| 8,221,586 | B2 | 7/2012 | Haslop | |
| 8,673,114 | B2 * | 3/2014 | Krul | D21F 1/0063 162/109 |
| 8,840,756 | B2 * | 9/2014 | Doublet | D21F 11/006 162/141 |
| 2004/0249754 | A1 | 12/2004 | Kaule et al. | |
| 2005/0244720 | A1 | 11/2005 | Doublet | |
| 2009/0001709 | A1 | 1/2009 | Kretschmar et al. | |
| 2013/0049350 | A1 * | 2/2013 | Pallota | D21F 1/44 283/85 |

FOREIGN PATENT DOCUMENTS

| | | | | |
|---|---|---|---|---|
| EP | 2439074 | A2 | | 4/2012 |
| EP | 2826915 | A1 | | 1/2015 |
| JP | 2008261085 | A | | 10/2008 |
| WO | WO 2007/028485 | | * | 3/2007 |
| WO | 2011081561 | A1 | | 7/2011 |
| WO | 2011137941 | A1 | | 11/2011 |
| WO | 2013140126 | A1 | | 9/2013 |
| WO | WO 2014/065713 | | * | 5/2014 |

OTHER PUBLICATIONS

WO 2014/065713, English language machine translation [epo.org]. (Year: 2014).*

European Patent Office, "Communication pursuant to Rules 161(1) and 162 EPC," Application No. EP18710267.8, dated Oct. 18, 2019, 4 pages.

International Search Report and Written Opinion of the International Searching Authority for International Application No. PCT/US2018/019776, dated May 11, 2018, 10 pages.

International Preliminary Report on Patentability for International Application No. PCT/US2018/019776, dated Sep. 6, 2019, 9 pages.

* cited by examiner

PAPER INCLUDING ONE OR MORE MULTI-TONAL WATERMARKS HAVING FULL TONALITY, AND AN IMPROVED WATERMARKING TOOL FOR MANUFACTURING SUCH PAPER

RELATED APPLICATION

This application claims priority to U.S. Provisional Patent Application No. 62/464,011, filed Feb. 27, 2017, which is incorporated herein in its entirety by reference.

TECHNICAL FIELD

The invention generally relates to paper including one or more multi-tonal watermarks having full tonality, and to an improved watermarking tool for manufacturing such paper.

BACKGROUND

Security papers are used for manufacturing security documents such as banknotes, passports, postage stamps and the like. Conventionally, a wide variety of security features are incorporated into such security papers or provided on their surface. Known examples include watermarks, embedded and windowed security threads, fluorescent pigments and the like.

Watermarks, which are recognizable images or patterns in paper that appear as various shades of lightness/darkness when viewed by transmitted light or by reflected light atop a dark background, have provided protection against counterfeiting security documents for hundreds of years. In fact, watermarks and their engaging designs are the most readily recognized security feature available to the general public for the authentication of security documents such as banknotes.

High security multi-tonal watermarks are typically made using a cylinder mould process. A multi-tonal watermark is often a graphic image (e.g., a portrait), which may originate from a greyscale image of the desired subject matter such as the greyscale image of John F. Kennedy shown in FIG. 1. The multi-tonal watermark can be very detailed and complex which significantly reduces the risk of counterfeiting. These watermarks are formed by varying the density of paper fibers so that in some regions the collection of fibers is denser and in other regions the collection of fibers is less dense than that of the base paper which surrounds and separates some or all of these regions. When viewed in transmitted light, the less dense regions are lighter and the denser regions are darker than the base paper.

In conventional watermarking using a cylinder-mould process, paper is formed on a partially submerged wire-mesh covered mould cylinder, which rotates in a vat containing a dilute suspension of paper fibers. As the mould cylinder rotates, water is drawn through the wire-mesh depositing fibers onto the mesh. When the wire-mesh is embossed with a detailed image using a pair of dies (male and female embossing dies), the fibers deposit with a less or greater thickness on the raised and recessed elements of the embossing to form a fully three-dimensional watermark in the finished paper. The same greyscale image of John F. Kennedy shown in FIG. 1 rendered as a three-dimensional (3D) male embossing die is shown in FIG. 2. A wire-mesh embossed with this 3D male embossing die and with a corresponding 3D female embossing die, also rendered from the same image, is shown in FIG. 3.

High security multi-tonal watermarks may also be made using a Fourdrinier process which employs a dandy roll having raised and/or recessed areas on the surface.

As best shown in FIG. 4, drawbacks noted with respect to conventional watermarking include: (1) that the process of embossing wire-mesh fails to transfer all of the information from the dies to the forming surface, meaning that the watermark will never be as detailed as the original artwork; (2) the wire-mesh forms its own impression which detracts from the aesthetics and resolution of the watermark; (3) the watermark lacks tonality (i.e., the contrast of dark to light is less pronounced) and (4) the contrast of the watermark is defined partially by the depth of the embossing, so while increasing the embossing depth can improve watermark contrast, this typically has a negative effect on the lifespan of the mould cover.

An alternative process for generating uniform light tonal regions in paper is the electrotype process. This electrotyping process is well known in papermaking and has been described in U.S. Pat. Nos. 1,901,049 and 2,009,185. In the electrotype process, a thin piece of metal (i.e., a perforated plate) generally in the form of an image, is applied (by sewing or welding) to the wire-mesh of the cylinder mould cover causing a significant decrease in drainage and fiber deposition and thereby forming a light watermark in the paper. An electrotype watermark is typically lighter than a watermark produced by conventional embossing. A drawback associated with this technology is that the electrotypes have limited functionality in that it is very difficult to produce complicated features such as Arabic words.

An example of a electrotype watermark is the Pixel™ watermark, which was developed by Arjowiggins Security. The Pixel™ watermark is a multi-tonal watermark having a unique appearance obtained by a contrast of light dots or bars on the background paper. EP 1 122 360 A1 describes pixel watermarking where an electrotype watermark element carries an image in the form of a halftone (see FIG. 5). The halftone image is formed on a flat substrate, such as a sheet of nickel or copper, and then welded to a mould surface. The resulting watermark is a light watermark with a halftone, giving the impression of tonality. The Pixel™ watermark does not provide full tonality (depth).

SUMMARY OF THE INVENTION

In particular, the present invention provides paper based on a fiber composition, the paper comprising at least one multi-tonal watermark having full tonality (depth). The term "full tonality", as used herein, is intended to mean full tonal gradation (i.e., covering all the tones) between the lightest areas (typically lighter than the background paper) and the darkest areas (typically darker than the background paper).

The present invention also provides an improved watermarking tool selected from the group of:

(I) an assembly that comprises an electrotype element (i.e., a perforated plate) representing a halftone image of a watermark, and a wire-mesh for use in the manufacture of watermarked paper, wherein the electrotype element is affixed to the wire-mesh, and wherein the electrotype element and the wire-mesh are pressed or embossed, either separately or together in register, with the image of the watermark represented by the electrotype element;

(a) in one exemplary embodiment, the assembly is a watermarking device that comprises (i) a wire-mesh element including an embossed wire area having a wire-mesh relief structure, and including a perforation pattern; and (ii) an electrotype element including an embossed electrotype area having an electrotype relief structure, and including a set of perforations preferably distributed in a pattern; wherein the electrotype element is coupled to the wire-mesh element such that the wire-mesh relief structure and the electrotype relief structure are at least partially overlapped to form an overlapping area bound by the area of overlap between the electrotype relief structure and the wire-mesh relief structure; and (II) an enhanced wire-mesh comprising woven wires arranged in a grid (e.g., a regular or substantially regular grid), wherein areas of the grid are filled with a polymeric material which forms regions of blocked drainage, wherein the wire-mesh including open areas as well as those areas filled with the polymeric material are pressed or embossed with an image of a watermark. The areas containing the polymeric material are blinded but not raised above the level of the wire-mesh.

Watermarking Device

In a preferred embodiment, the watermarking device is formed by embossing an indicia into the wire-mesh element and embossing an indicia into the electrotype element. While numerous methods of embossing will be apparent to a person having ordinary skill in the art (PHOSITA), one suitable means is by use of complementary male and female dies into which the an image is positively and negatively formed, respectively. The wire-mesh element and the electrotype element are placed between the male and female dies. Preferably, the electrotype element is disposed between the wire-mesh element and the male die while the wire-mesh element is disposed between the female die and the electrotype element. The electrotype element having more surface area than the wire-mesh element, permits more information from the dies (male and/or female) to be transferred to the wire-mesh electrotype couple. As such, the couple transfers more information from the dies to the substrate (i.e., security document). As such, an image can be transferred from a die to a document with high fidelity in the image resolution. Moreover, the couple, having an overlapping area where a wire-mesh relief structure overlaps with an electrotype relief structure in the wire-mesh element and electrotype element, respectively, provides a watermark element with full tonality.

The present invention also provides a method of forming a watermarking device, such as that disclosed throughout herein, wherein the method comprises: (1) providing a wire-mesh element including an embossed wire area having a wire-mesh relief structure; (2) providing an electrotype element including an embossed electrotype area having an electrotype relief structure, and including a set of perforation, preferably a pattern of perforation (perforation pattern); and (3) coupling the electrotype element to the wire-mesh element such that at least one of the wire-mesh relief structure and at least one of the electrotype relief structure are at least partially overlapped, thereby forming an overlapping area.

The present invention further provides a watermarked document comprising: (1) a substrate; (2) a watermark element in at least one surface of the substrate: wherein the watermark element comprises a document relief structure having (i) a wire-meshed indicia and (ii) an electrotyped indicia at least partially overlapping the wire-meshed indicia to form an overlapping area such that the watermark element has full tonality in the overlapping area.

The present invention further provides a method of forming a watermarked document comprising: (1) interfacing a watermarking device, described throughout herein, with a slurry of fibers; (2) draining liquid from the slurry through the electrotype element and wire-mesh element couple; wherein the watermark element has a relief structure having (i) a wire-meshed indicia and (ii) an electrotyped indicia at least partially overlapping the wire-meshed indicia to form an overlapping area such that the watermark element has full tonality in the overlapping area.

The present invention further provides a use of the watermarking device, as disclosed herein, to secure a document by imparting a watermark element to a substrate surface of the document. In a particular embodiment, the watermark element has a relief structure having (i) a wire-meshed indicia and (ii) an electrotyped indicia at least partially overlapping the wire-meshed indicia to form an overlapping area such that the watermark element has full tonality in the overlapping area.

In one particular embodiment of the present invention, the image from the die or dies used to press or emboss the image into the electrotype element and wire-mesh is transferred with high fidelity while allowing a broad spectrum of tones in the resulting watermark that range from very light to very dark. The image seen in the electrotype element increases the tonality of the watermark. The pressing or embossing occurs into a surface that is less 'lossy' than a wire-mesh. In other words, more of the information from the die would be transferred to the forming surface if the forming surface were an electrotype than if it were a wire-mesh. This is due, at least partly, to the fact that a wire-mesh has less embossable surface area onto which a die image can be transferred. Moreover, the increased tonality in the watermark is achieved without any increase in the embossing depth of the forming surface and thus without any loss of mould cover life.

The present>invention also provides a method of manufacturing the inventive assembly, the method comprising:

(a) providing an electrotype element representing a halftone image of a watermark;

(b) providing a wire-mesh for use in manufacturing watermarked paper; and then either:

affixing the electrotype element to the wire-mesh to form an assembly and then pressing or embossing the assembly with the image of the watermark represented by the electrotype element; or separately pressing or embossing the electrotype element and the wire-mesh with the image of the watermark in register and then affixing the pressed or embossed electrotype element to the pressed or embossed wire-mesh to form an assembly.

An assembly made in accordance with the above method is also provided.

Further provided is a method for improving a wire-mesh used in the manufacture of watermarked paper, the method comprising affixing an electrotype element representing a halftone image of a watermark to the wire-mesh, wherein either (a) the electrotype element and the wire-mesh are separately pressed or embossed with the image of the watermark and then joined together in register to form an assembly, or (b) the joined assembly, of electrotype element and wire-mesh element, is pressed or embossed with the image of the watermark represented by the electrotype element.

Enhanced Wire-Mesh

By way of this embodiment of the present invention, regions of blocked drainage are formed within a wire-mesh, which has a similar effect of applying one or more miniature and complex electrotypes.

A method of manufacturing the inventive enhanced wire-mesh comprises:

pressing or embossing an image into the wire-mesh to form an embossed region using a set of stamps or dies positioned on opposing sides of the wire-mesh, a first die positioned on a backside of the wire-mesh comprising a face with the image depressed within the face (i.e., a female embossing die) and a second die positioned on a frontside of the wire-mesh comprising a face with the raised image thereon (i.e., a male embossing die);

removing the second or male die from the frontside of the embossed region while leaving the first or female die in place on the backside of the embossed region;

placing a piece of polymeric material (e.g., malleable polymer film such as a thermoplastic or thermoset elastomer material) over the embossed region of the wire-mesh;

providing a customized male die, which comprises a face with select raised portions of the image thereon, wherein the select raised portions are positioned where drainage blocking is to occur on the wire-mesh;

forcing the polymeric material into the woven structure of the wire-mesh using the customized male die only where the select raised portions of the die make contact with the polymeric material and the wire-mesh, thereby forming an enhanced wire-mesh; and removing excess polymeric material from the enhanced wire-mesh, wherein the enhanced wire-mesh will block water drainage during papermaking in regions occupied by the polymeric material, which will result in thinner paper being formed, thereby expanding the tonal range of the resulting watermark.

An enhanced wire-mesh made in accordance with the above method is also provided.

Further provided is a method for using a customized male die to enhance a wire-mesh having a woven structure that is embossed with an image, the method comprising using the customized male die, which comprises a face with select raised portions of the image thereon to force a polymeric material into the embossed woven structure of the wire-mesh, wherein the polymeric material is forced into the woven structure only in those regions where the select raised portions of the die make contact with the polymeric material or the polymeric material and the wire-mesh, wherein the enhanced wire-mesh will block water drainage during papermaking in regions occupied by the polymeric material, which will result in thinner areas being formed in the paper, thereby expanding the tonal range of the resulting watermark.

A method for expanding the tonal range of a multi-tonal watermark is also provided, the method comprising using the above-described assembly or enhanced wire-mesh during papermaking to form one or more multi-tonal watermarks having full tonality.

The present invention also provides a multi-tonal watermark having full tonality (depth) as well as a paper having one or more such multi-tonal watermarks, which are made using either the inventive assembly or inventive enhanced wire-mesh described above.

Other features and advantages of the invention will be apparent to one of ordinary skill from the following detailed description and drawings.

Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

Particular features of the disclosed invention are illustrated by reference to the accompanying drawings in which:

FIG. 8*a* is an image of an embodiment of the multi-tonal watermark having full tonality (depth) of the present invention, the watermark made using the electrotype element/wire-mesh assembly shown in FIG. 7, while

FIG. 10*a* is an image of a 3D female embossing die rendered from the artwork of John F. Kennedy, while

DETAILED DESCRIPTION OF THE INVENTION

Figure 1:
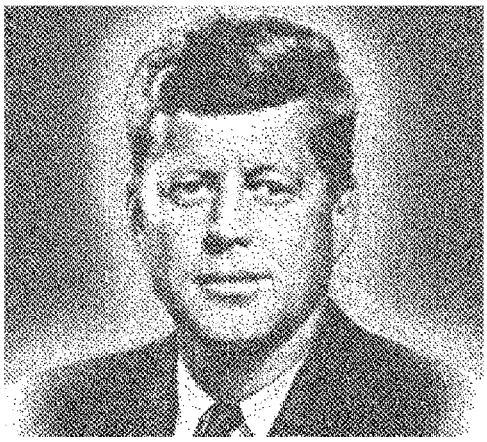
FIG. 1 is artwork of John F. Kennedy, shown as a greyscale image.
Figure 2:
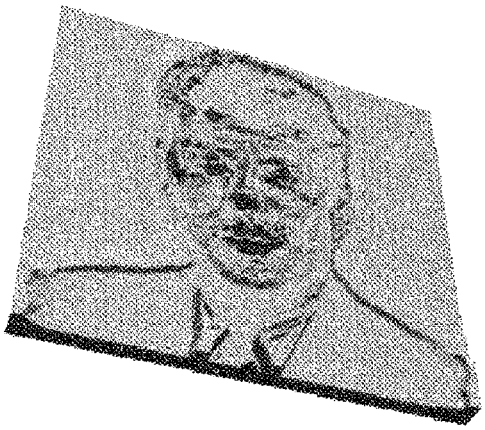
FIG. 2 is the same artwork of John F. Kennedy, rendered as a three-dimensional (3D) male embossing die.
Figure 3:
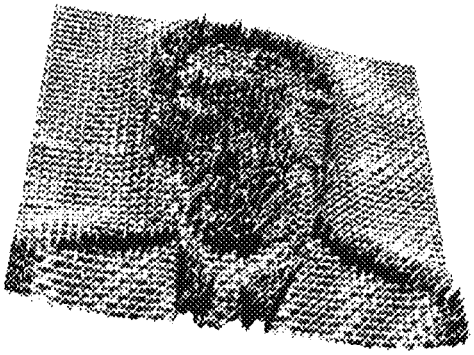
FIG. 3 is a wire-mesh after being embossed with the 3D male embossing die shown in FIG. 2 and with a 3D female embossing die, which was also rendered from the artwork shown in FIG. 1.
Figure 4:
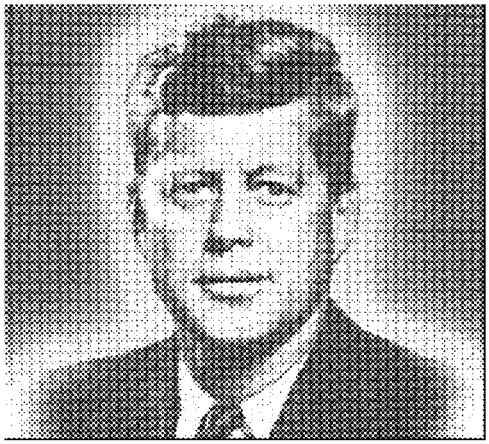
FIG. 4 is an image of a watermark made using the 3D male and female embossing dies in a conventional watermarking process.
Figure 5:
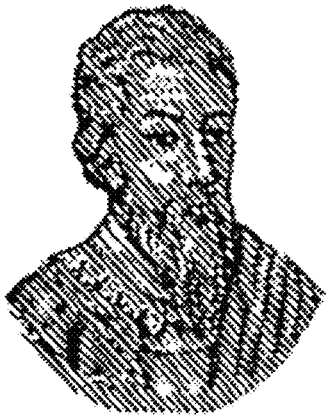
FIG. 5 is an image of a halftone rastered electrotype, as shown in EP 1 122 360 A1.

The paper of the present invention is based on a fibrous composition, the paper comprising at least one multi-tonal watermark having full tonality (depth). The paper may constitute a single or multi-ply sheet material, which may be made from a range of fiber types including synthetic or natural fibers or a mixture of both. For example, these sheet materials may be made from fibers such as abaca, cotton, linen, wood pulp, polymers/plastics and blends thereof. As is well known to those skilled in the art, cotton and cotton/linen or cotton/synthetic fiber blends are preferred for banknotes, while wood pulp is commonly used in non-banknote security documents.

Watermarking Device

The watermarking device of the present invention includes a wire-mesh element that is coupled to an electrotype element. In one embodiment, the wire-mesh element is a wire-mesh screen of weft and warp wires where the warp wires cross alternately above and below the weft wires and vice versa such that an opening, bordered by the crossing pairs of weft and warp wires, is formed in the screen. The openings in the screen can take many shapes, though it preferred that the openings have a parallelogram shape such as a rhomboid, square or rectangle.

An embossed wire area having a wire-mesh relief structure in the form of indicia, is also formed in the wire-mesh element. This wire-mesh relief structure can be formed by various methods including embossing with a set of male and female dies having the desired positive and negative indicia.

In one embodiment, the electrotype element is selected from any material into which an indicia, such as text, numbers, symbols, or images may be formed. Preferably, the electrotype element material, in at least one state, is malleable such that it can be molded or embossed to form a desired relief structure in the form of a desired indicia. In a preferred embodiment, the electrotype element is a small metal or metal-like part.

The electrotype element, in one embodiment, includes an embossed electrotype area having an electrotype relief structure and including a set of perforations. The embossed electrotype area corresponds to areas in the electrotype where the dies are impressed into the surface of the electrotype element such that the indicia in the dies are transferred to the electrotype element. These embossed electrotype areas have indicia such as text, numbers, symbols or images. The indicia is formed as an electrotype relief structure in the electrotype element. A set of perforations, which may be randomly distributed or organized in a preferred pattern, extend from a top surface of the electrotype element towards a bottom surface of the electrotype element. In some embodiments, at least some of the perforations terminate within the height of the electrotype element while in other embodiments the perforations extend through the bottom surface of the electrotype element. The perforations may take any shape including but not limited to circular, oval, parallelogram or any combination thereof. In a preferred embodiment the perforations are conical such that they taper from the bottom to the top or from the top to the bottom of the electrotype element, or may taper from both or either surface to a point between the top and bottoms surface. Where the perforations are conical and the electrotype element is coupled to the wire-mesh element, it is preferred that the perforations extend from the top surface of the electrotype element, distal of the wire-mesh element, through a bottom surface of the electrotype element, proximate the wire-mesh element. The internal circumferences of the conical perforations expand as they travel from the top surface toward the bottom surface. The perforations may be formed by any method suitable including but not limited to molding, laser perforation or mechanical drilling. Arrangement of the perforations may be such that they create a pixeled pattern in the resultant fibrous substrate such that a high accumulation of light dots or low accumulation of dark dots creates the impression of light areas in a resultant watermark whereas a high accumulation of dark dots or low accumulation of light dots creates the impression of dark areas in a resultant watermark. In a preferred embodiment, the set of perforations are arranged in a pattern thereby creating a desired dot pattern of halftone dark and light areas. Importantly, in one embodiment, the set of perforations are arranged in the shape of indicia such that the pattern of dots/pixels form one or more text, letter, symbol, number or image.

The electrotype element is coupled to the wire-mesh element (as exemplified in FIG. 7) such that at least a portion of the indicia formed by the wire-mesh relief structure overlaps with at least a portion of the indicia formed by the electrotype relief structure, thereby forming an overlapping area that provides full tonality in a resultant watermarked document. In a preferred embodiment, in the overlapping area the electrotype relief structure has an area that is situated within the boundary of the wire-mesh relief structure, or vice versa. However, it is also contemplated herein that the overlapping area comprises the overlapping of a portion of the wire-mesh relief structure and a portion of the electrotype relief structure. The overlapping area is bound by the area of overlap between the electrotype relief structure and the wire-mesh relief structure. Coupling of the wire-mesh element to the electrotype element may be by various means known to a PHOSITA including coupling the wire-mesh element to the electrotype element such that at least one of the wire-mesh relief structures and at least one of the electrotype relief structures are at least partially overlapped. The coupling may be by gluing, welding, brazing, stitching, stapling or other fastening means. For example, the simultaneous embossing of the wire-mesh element and the electrotype element, in one embodiment, has been found suitable for coupling the two elements and is therefore contemplated herein as a suitable means of coupling the two elements to form a wire-mesh electrotype couple.

It is contemplated herein that the coupling of the wire-mesh element and the electrotype element provides for the full overlap of the electrotype relief structure and the wire-mesh relief structure. Alternatively, it is also contemplated herein that the relief structures are only partially overlapped or are overlapped in a complementary manner to form a composite indicia. While the indicia provided by each relief structure, in the wire-mesh and in the electrotype, may be the same, it is also contemplated that each indicia is different.

In another aspect of the present invention, a method of forming a watermarking device is provided. The method comprises providing a wire-mesh element as disclosed herein; providing an electrotype element as disclosed herein; and coupling the electrotype element to the wire-mesh element such that at least one of the wire-mesh relief structures and at least one of the electrotype relief structures are at least partially overlapped. Coupling of the elements may precede or follow the embossing of the indicia in the wire-mesh and the electrotype. For example, in one embodiment, a first relief structure (wire-mesh relief structure) is formed in the wire mesh element. A second relief structure (electrotype relief structure) that is the same as the wire-mesh relief structure or different from the first relief structure is formed in the electrotype element In either case, at least a portion of the second relief structure overlaps with at least a portion of the first relief structure to form the overlapping area. Coupling of the wire-mesh element to the electrotype element comprises disposing a coupling mechanism between the wire-mesh element and the electrotype element. As such, it is meant that the elements are either coupled by an adhesive, glue or welding: or in the alternative are fastened together by the simultaneous embossment of the wire-mesh element and the electrotype element to form the wire-mesh relief structure and the electrotype relief structure together. It is also contemplated herein that the electrotype element and the wire-mesh element are sequentially embossed to form the electrotype relief structure and the wire-mesh relief structure, respectively.

In another aspect of the present invention, a use is provided wherein the watermarking device is used to secure a document by imparting a watermark element to the document. The watermarking device is used to secure a document by imparting a watermark element to a substrate surface of the document. For example, the watermarking device is interfaced with a slurry of fibers during paper manufacture such that a portion of liquid from the slurry is drained through the watermarking device during the paper making process.

The overlapping area, as described herein throughout, having overlapping relief structures from the wire-mesh element and from the electrotype element, and having a set of perforations in the electrotype element, produces a watermark element with (1) a watermark relief feature based on the overlapped relief structures from the wire-mesh element and from the electrotype element and also (2) a watermark pixel feature based on the arrangement of the set of perforations in the electrotype element. The combination of the watermark relief feature and the watermark pixel feature provides a watermark having full tonality. As will be readily understood by a person having ordinary skill in the art, the relief structures in the wire-mesh element allows more fibers from the slurry to accumulate in the areas of the slurry interfacing with regions of the relief structure that have greater depth—thereby creating darker areas (relative to the surrounding areas) in the resultant document (e.g., banknote). Alternatively, the regions of the relief structure having less depth or which protrude above the surrounding regions of the relief structure, will limit the accumulation of fibers, thereby creating lighter areas (relative to the surrounding areas) in the resulting document. Likewise, the overlapping relief structure in the electrotype element also creates similar dark and light tones by the same process. Coupled together and overlapping, these respective relief structures are used to redistribute fibers in the slurry to generate a range of tones from dark to light in the watermark element. Because of the presence of the electrotype element, lighter regions can be placed directly next to dark regions without risking damage to the wire-mesh screen. Moreover, the presence of the perforations—which may be arranged in any desired pattern—in the electrotype element is preferably arranged such that the perforations are distributed in a manner to create dark regions where there are high accumulations of the perforations and create light areas where there are low accumulations of the perforations. These dark and light regions thereby give the impression of tonality. In a preferred embodiment, the full range of tones is coordinated with the range of tones provided by the relief structures. The combination of this watermark pixel feature with the watermark relief feature provides a watermark having full tonality thereby displaying a full range of grey tones from dark to light.

As used herein throughout, the term "watermark element", is to be understood as a watermark with at least portions thereof having full tonality provided by the overlapping region of the wire-mesh electrotype couple.

While it is preferred that the perforations are formed prior to the formation of the relief structure into the electrotype element, it is also contemplated that the perforations are formed after the indicia is formed into the electrotype element. Moreover, it is also contemplated that the perforations are formed before or after the electrotype element is coupled to the wire-mesh element.

In another aspect of the invention, a watermarked document is provided which comprises (1) a substrate; and (2) a watermark element in at least one surface of the substrate. The substrate as used herein refers to the document, such as a paper made from a fibrous material. Exemplary documents include but are not limited to identification documents, banknotes, checks, and official government documents. The watermark element is a full tonality watermark. The full tonality watermark is present in at least one surface of the document and is observable in at least transmitted light. The watermark element has a document relief structure having (i) a wire-meshed indicia and (ii) an electrotyped indicia at least partially overlapping the wire-meshed indicia to form an overlapping area such that the watermark element has full tonality in the overlapping area. To form the watermarked element, the watermarking device is interfaced with the substrate such that the overlapping area creates the document relief structure in the substrate. In one embodiment the wire-meshed indicia is formed by the wire-mesh relief structure in the wire-mesh element while the electrotype indicia is formed by the electrotype relief structure in the electrotype element.

The wire-meshed indicia, in one embodiment, is identical to the overlapping electrotype indicia within the overlapping area but are different outside the overlapping area. In an alternative embodiment the wire-meshed indicia and the electrotyped indicia are identical and are fully overlapped.

In another aspect, a method of forming a watermarked document is provided where the method comprises: (1) interfacing the watermarking device disclosed herein, with a slurry of fibers; and (2) draining liquid from the slurry through the coupled electrotype element and wire-mesh element to form a watermark element. The watermark element has a relief structure having (i) a wire-meshed indicia and (ii) an electrotyped indicia at least partially overlapping the wire-meshed indicia to form an overlapping area such that the watermark element has full tonality, at least in the overlapping area. The resultant watermarked document includes a watermarked element having a watermark relief feature overlapped with a watermark pixel feature. The pixel feature being formed from the set of perforations present in the electrotype element and the watermark relief feature being formed from the combination of the relief structures in the wire-mesh element and the electrotype element.

In a particular example, the improved watermarking device of the present invention in the form of an assembly comprises an electrotype element representing a halftone image of a watermark, which is affixed to a wire-mesh. The electrotype element and the wire-mesh have watermarking images that are aligned in register, such that at least a portion of the image in the electrotype element overlaps at least a portion of the image in the wire-mesh. This is to be understood herein as registration of the electrotype element to the wire-mesh. Registration is preferably full registration and the images are preferably identical. However, it is also contemplated herein that the images may be different or may be only substantially similar. The electrotype element and the wire-mesh may be pressed or embossed with the image of the watermark separately and then joined together in register, or they may be joined together and then both pressed or embossed with the image of the watermark.

Wire-mesh or wire cloth is fabric woven from wire (e.g., a copper, bronze or synthetic screen). Typically, the mesh size ranges from about 60×60 strands per inch to about 70×90 strands per inch, and the thickness of the wire-mesh ranges from about 0.15 to about 0.4 millimeters (mm). Where this is a woven structure, the open regions within the weave will typically have a parallelogram shape (e.g., rhomboid, square or rectangular).

Figure 6:
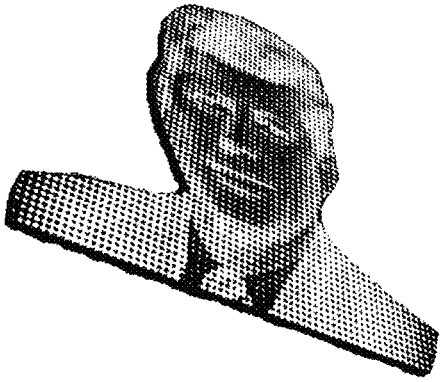
FIG. 6 is an image of an embodiment of the electrotype element of the present invention prior to embossing, which was formed from the artwork of John F. Kennedy shown in FIG. 1 after being rastered into a halftone.

The electrotype element of the present invention is a small metal or metal-like part or plate, which in an exemplary embodiment shown in FIG. 6 is shaped and perforated in the form of an image of John F. Kennedy. The image represented by the electrotype element is not limited and may assume any shape or size including large or small graphic images (e.g., portraits), letters, numbers, symbols, etc. The thickness of the electrotype element typically ranges from about 0.05 mm to about 0.75 mm. Holes extend through the thickness of the electrotype element, with each hole measuring from about 0.2 mm to about 2.0 mm in diameter. The spacing between holes in the electrotype element may be regular or irregular, and typically ranges from about 0.2 mm to about 4.0 mm.

The electrotype element may be prepared using, for example, a soft metal (e.g., copper or nickel), a cured polymer (e.g., polyurethane), or a resin (e.g., epoxy resin), which is either etched (e.g., laser etching, chemical etching), grown (i.e., electroforming), 3D printed, or formed by photochemical techniques to reflect the image and/or text. In a preferred method for producing the electrotype element, the element is made by laser etching through a thin copper, phosphor bronze, or German silver sheet.

Before or after the electrotype element is affixed to the wire-mesh, the electrotype element and the wire-mesh are pressed or embossed (using embossing dies) with the same image reflected in the electrotype element. The wire-mesh may be pressed or embossed using a set of stamps or dies positioned on opposing sides of the wire-mesh, a first die positioned on a backside of the wire-mesh comprising a face with the image depressed within the face and a second die positioned on a frontside of the wire-mesh comprising a face with the raised image thereon.

Figure 7:
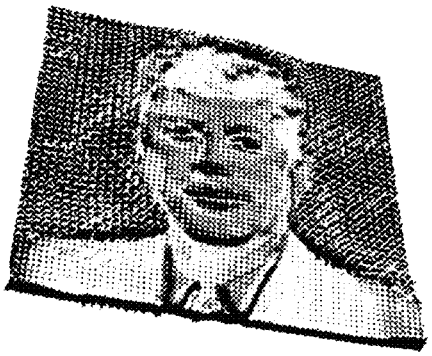
FIG. 7 is an image of an embodiment of the electrotype element/wire-mesh assembly of the present invention in which the halftone rastered electrotype element of FIG. 6 is applied/affixed to a wire-mesh and the resulting assembly embossed with a 3D relief of the same image of John F. Kennedy.

The electrotype element is affixed to the wire-mesh by, for example, welding, brazing, adhering, stitching, or stapling, resulting in the electrotype element/wire-mesh assembly shown in FIG. 7.

The embossing dies for making watermarking wire-mesh or wire cloths of the present invention may be prepared using known techniques from any image whether pre-existing (e.g., the artwork of John F. Kennedy shown as a greyscale image in FIG. 1) or made, for example, at a workstation.

By way of explanation, starting from the greyscale image shown in FIG. 1, this image may be digitized by pixels or vectors using techniques well known in the art. For example, image sensing from the greyscale image may be by means of a scanner using commercial software. When sensing the image digitally, values are obtained which correspond to x-y coordinate dots and with shades of gray corresponding to the depth z of the desired engraving.

Using commercial software, the image values can be modified, for example, by enlarging, reducing, or transforming (symmetrically or homothetically) the values. The image values or modified image values are then stored in a file and next fed to another computer outfitted with software allowing it to form a 3D version of the image using the stored image values.

The 3D version of the image is then transformed into curves forming a "grid" defining the engraving path. The resulting curve data is then processed by software to determine the path of the engraving tool or milling machine (e.g., a CNC mill). The dies (male and female engraving dies) are then engraved by automation.

Figure 8A:
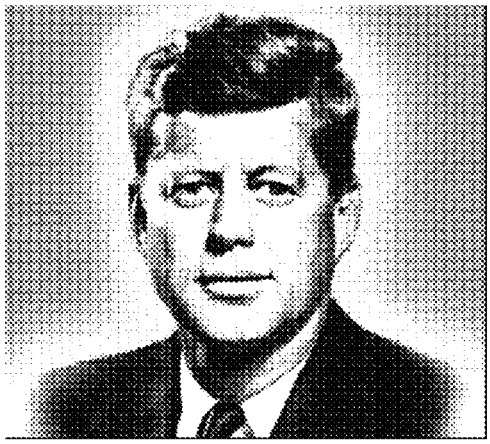
Figure 8B:
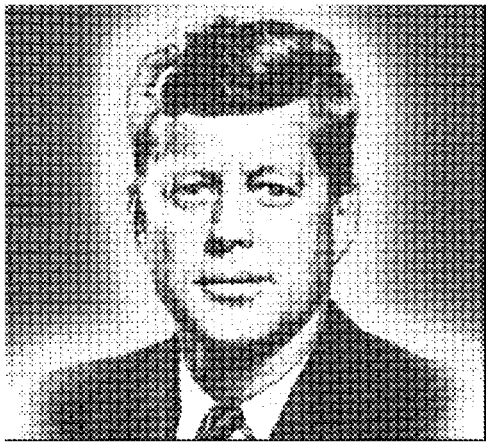
FIG. 8*b* is the image shown in FIG. 4 of a watermark made using 3D male and female embossing dies in a conventional watermarking process.

A multi-tonal watermark made using the electrotype element/wire-mesh assembly of the present invention is shown in FIG. 8*a*. As will be readily appreciated when comparing the multi-tonal watermark of the present invention to a conventional watermark, as shown in FIG. 8*b*, the multi-tonal watermark of the present invention provides more image detail and a much broader spectrum of tones.

As noted above, an assembly made in accordance with the above method is also provided by way of the present invention.

Further provided is a method for improving a wire-mesh used in the manufacture of watermarked paper. The method comprises affixing an electrotype element representing a halftone image of a watermark to the wire-mesh, wherein either (a) the electrotype element and the wire-mesh are separately pressed or embossed with the image of the watermark and then joined together in register to form an assembly, or (b) the joined assembly is pressed or embossed with the image of the watermark represented by the electrotype element.

Enhanced Wire-Mesh

Figure 9:
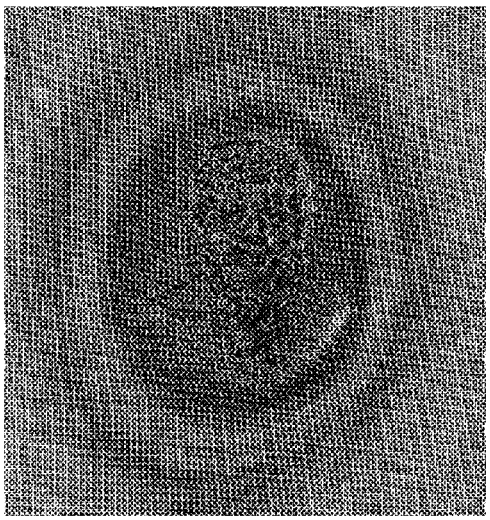
FIG. 9 is an image of a wire-mesh after being embossed with the 3D female embossing die shown in FIG. 10*a* and the 3D male embossing die shown in FIG. 10*b:*
Figure 10A:
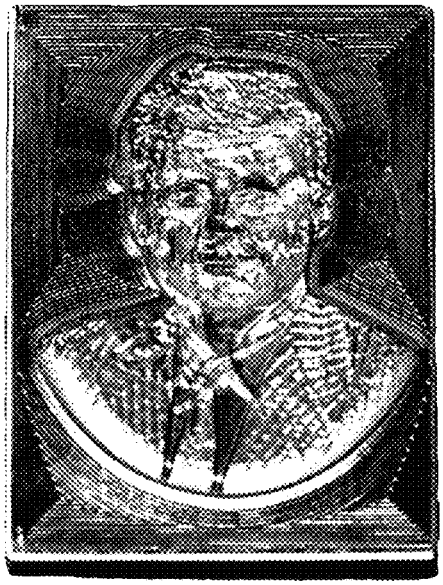
Figure 10B:
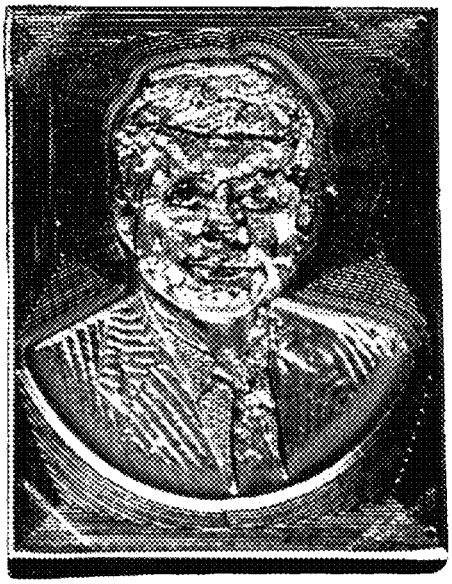
FIG. 10*b* is an image of a 3D male embossing die rendered from the same artwork of John F. Kennedy.
Figure 11:
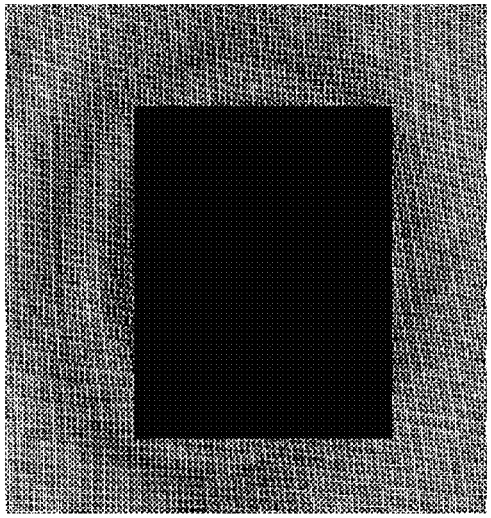
FIG. 11 is an image of the wire-mesh shown in FIG. 9 after a piece of polymeric material has been placed over the embossed region of the wire-mesh.
Figure 12:
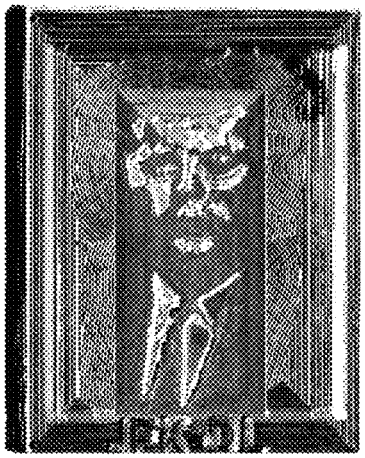
FIG. 12 is an image of a customized male die, which comprises a face with select raised portions of the artwork of John F. Kennedy thereon.
Figure 13:
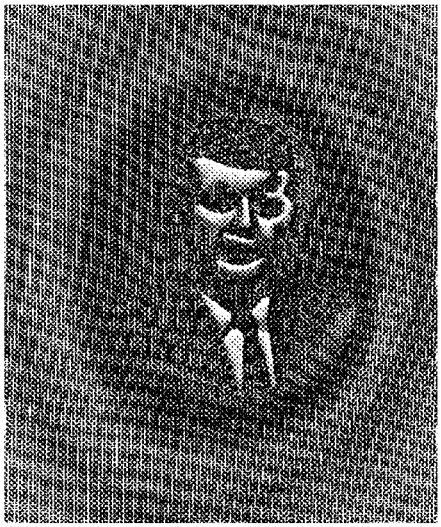
FIG. 13 is an image of an embodiment of the enhanced wire-mesh of the present invention, which was made by forcing the polymeric material in the woven structure of the wire-mesh using the customized male die shown in FIG. 12.

The improved watermarking tool of the present invention in the form of an improved wire-mesh comprises woven wires which may be arranged in a regular or substantially regular grid. Areas of the grid are filled with a polymeric material which forms regions of blocked drainage. The wire-mesh including open areas as well as those areas filled with the polymeric material are pressed or embossed with an image of a watermark, In an exemplary embodiment, the inventive enhanced wire-mesh is made by:

pressing or embossing (as described above) an image into the wire-mesh to form an embossed region, such as that shown in FIG. 9, using a set of stamps or dies positioned on opposing sides of the wire-mesh. A first die, such as that shown in FIG. 10*a*, is positioned on a backside of the wire-mesh and comprises a face with the image depressed within the face. A second die, such as that shown in FIG. 10*b*, is positioned on a frontside of the wire-mesh and comprises a face with the raised image thereon;

removing the second or male die from the frontside of the embossed region while leaving the first or female die in place on the backside of the embossed region, placing a piece of polymeric material, such as that shown in FIG. 11, over the embossed region of the wire-mesh;

providing a customized male die, such as that shown in FIG. 12, which comprises a face with select raised portions of the image thereon;

forcing the polymeric material in the woven structure of the wire-mesh using the customized male die. The polymeric material is forced in the woven structure of the wire-mesh only where those select raised portions of the die make contact with the polymeric material and the wire-mesh; and removing excess polymeric material from the enhanced wire-mesh, wherein the resulting enhanced wire-mesh, such as that shown in FIG. 13, will block water drainage during papermaking in regions occupied by the polymeric material, which will result in thinner watermarked paper regions being formed, thereby expanding the tonal range of the resulting watermark.

The polymeric material may extend fully or partially over the embossed region of the wire-mesh and may be made of a malleable polymer film such as a thermoplastic or thermoset elastomer material having a thickness ranging from about 0.25 to about 1.5 mm. For example, the polymer film may be prepared using: a water-based dispersion of amorphous polymers with a glass transition temperature ($T_g$) below the drying temperature but above the paper machine (PM) operating temperature (e.g., some polyurethanes, acrylates, fluoropolymers, polyvinyl alcohol)); solvent-based dispersions of amorphous polymers where evaporation of the solvent results in a hard material that is water resistance (e.g., acrylates (super glue)); thermoplastics which melt and thermoform into a desired position, shape and thickness and which are hard at operating temperatures, water resistant, and optionally abrasion resistant (e.g., acrylonitrile butadiene styrene (ABS), polycarbonate (PC), PC/ABS, olefins, thermoplastic polyurethanes (TPUs), polyvinyl chloride (PVC) (plasticized), acrylics (poly(methyl methacrylate) (PMMA)); high modulus thermosets (crosslinking) (e.g., epoxies, ultraviolet (UV)-curable resins (acrylates, urethane acrylates)). An additive that may be used for providing the polymer film with wear resistance includes, but is not limited to, polytetrafluoroethylene (PTFE).

As noted above, the customized male die comprises a face with select raised portions of the image thereon. The customized male die has only regions of highlights in the artwork that will be further enhanced by the resulting blockage of the woven structure by the polymeric material. In other words, the select raised portions are positioned where drainage blocking is to occur on the wire-mesh. In the customized male die shown in FIG. 12, the highlighted regions are portions of the facial region including the forehead, nose, cheekbones and chin, as well as portions of the shirt on either side of the necktie.

In an exemplary embodiment, the polymeric material is a thermoplastic polymer film, measures between 0.25 and 1 mm in total thickness, and is forced in the woven structure of the wire-mesh using the customized male die at a temperature high enough to soften the thermoplastic polymer film, but not melt the thermoplastic polymer to a molten state. The softened polymer film is pressed into the wire-mesh with the customized male die, with the female half of the die on the other side of the previously embossed formed wire. The pressure needed to push the softened polymer film into the selective regions of the wire-mesh is much lower than the force needed to make the initial embossment to form the watermark. The force will vary depending on the size and complexity of the watermark, but should be in the range of about 10 to about 100 pounds per square inch (psi).

As noted above, an enhanced wire-mesh made in accordance with the above method is also provided by way of the present invention.

Further provided is a method for using a customized male die to enhance a wire-mesh having a woven structure that is embossed with an image. The method comprises using the customized male die to force a polymeric material into the embossed woven structure of the wire-mesh, where the polymeric material is forced into the woven structure only in those regions where the select raised portions of the die make contact with the polymeric material and the wire-mesh, where the enhanced wire-mesh will block water drainage during papermaking in regions occupied by the polymeric material, which will result in thinner paper being formed, thereby expanding the tonal range of the resulting watermark.

As also noted above, a method for expanding the tonal range of a multi-tonal watermark is provided by way of the present invention. The method comprises using the above-described assembly or enhanced wire-mesh during papermaking to form one or more multi-tonal watermarks having full tonality.

Further provided is a multi-tonal watermark having full tonality (depth), as well as a paper having one or more such multi-tonal watermarks, which are made using either the inventive assembly or inventive enhanced wire-mesh described above.

While various embodiments of the present invention have been described above it should be understood that they have been presented by way of example only, and not limitation. Thus, the breadth and scope of the present invention should not be limited by any of the exemplary embodiments.

The invention claimed is:

1. A watermarking device comprising:

a wire-mesh element including an embossed wire area having a wire-mesh relief structure, the wire-mesh relief structure comprising indicia of a watermark; and an electrotype element including an embossed electrotype area having an electrotype relief structure, and including a perforation pattern, the perforation pattern comprising perforations based on a half-tone image of the indicia of the watermark, wherein the electrotype element is coupled to the wire-mesh element such that the wire-mesh relief structure and the electrotype relief structure overlap such that the indicia of the watermark are in register.

2. The watermarking device of claim 1, wherein the electrotype relief structure and the wire-mesh relief structure are fully overlapped.

3. The watermarking device of claim 1, wherein the electrotype relief structure and the wire-mesh relief structure are integrated.

4. The watermarking device of claim 1, wherein the perforations extend from a top surface of the electrotype element, distal of the wire-mesh element, through a bottom surface of the electrotype element, proximate the wire-mesh element.

5. The watermarking device of claim 4, wherein the perforations are conical in shape expanding in circumference from the top surface to the bottom surface.

6. A method of forming a watermarking device, the method comprising:

providing a wire-mesh element including an embossed wire area having a wire-mesh relief structure, the wire-mesh relief structure comprising indicia of a watermark;

providing an electrotype element including an embossed electrotype area having an electrotype relief structure, and including a perforation pattern, the perforation pattern comprising perforations based on a half-tone image of the indicia of the watermark; and coupling the electrotype element to the wire-mesh element such that the wire-mesh relief structure and the electrotype relief structure overlap such that the indicia of the watermark are in register.

7. The method of claim 6, wherein the step of coupling the wire-mesh element to the electrotype element comprises one or more of gluing, welding, brazing, stitching or stapling the wire-mesh element and the electrotype element together.

8. The method of claim 6, wherein the electrotype element and the wire-mesh element are first coupled then simultaneously embossed to form the wire-mesh relief structure and the electrotype relief structure.

9. The method of claim 6, wherein the electrotype element and the wire- mesh element are sequentially embossed to form the wire-mesh relief structure and the electrotype relief structure.

10. A watermarked document comprising:

a substrate; and a watermark element in at least one surface of the substrate, wherein the watermark element comprises a document relief structure having (i) a wire-meshed indicia and (ii) an electrotyped indicia at least partially overlapping the wire-meshed indicia to form an overlapping area such that the watermark element has full tonality in the overlapping area, wherein the electrotyped indicia comprises a halftone rendering of an image, and wherein the wire-meshed indicia and electrotyped indicia are in register in the overlapping area.

11. The watermarked document of claim 10, wherein the watermarked element is formed by interfacing a watermarking device with the substrate such that the overlapping area creates the document relief structure in the substrate, wherein the watermarking device comprises:

a wire-mesh element including an embossed wire area having a wire-mesh relief structure; and an electrotype element including an embossed electrotype area having an electrotype relief structure, and including a perforation pattern, wherein the electrotype element is coupled to the wire-mesh element such that the wire-mesh relief structure and the electrotype relief structure are at least partially overlapped to form an overlapping area bound by an area of overlap between the electrotype relief structure and the wire-mesh relief structure.

12. The watermarked document of claim 10, wherein the wire-meshed indicia is formed by a wire-mesh relief structure and the electrotyped indicia is formed by a electrotyped relief structure.

13. The watermarked document of claim 10, wherein the wire-meshed indicia and the electrotyped indicia are fully overlapped.

14. The watermarked document of claim 10, wherein the wire-meshed indicia and the electrotyped indicia are identical in the overlapping area but are different outside the overlapping area.

15. The watermarked document of claim 10, wherein the wire-meshed indicia and the electrotyped indicia are identical and are fully overlapped.

16. A method of forming a watermarked document comprising:

interfacing the watermarking device of claim 1, with a slurry of fibers; and draining liquid from the slurry of fibers through a coupled electrotype element and wire-mesh element to form a watermark element, wherein the watermark element has a relief structure having (i) a wire-meshed indicia and (ii) an electrotyped indicia, wherein the wire-meshed indicia comprises a pattern of perforations based on a half-tone image of a watermark, and wherein the wire-meshed indicia is coupled to the electrotyped indicia such that the wire- meshed indicia and the electrotyped indicia are in register.

17. The watermarking device of claim 1, wherein the wire-mesh element comprises raised regions of the wire-mesh relief structure in which a polymeric material fills holes in the wire-mesh element.

18. The method of claim 6, wherein the wire-mesh element comprises raised regions of the wire-mesh relief structure in which a polymeric material fills holes in the wire-mesh element.

19. The watermarked document of claim 11, wherein the wire-mesh element comprises raised regions of the wire-mesh relief structure in which a polymeric material fills holes in the wire-mesh element.

20. The method of claim 16, wherein the wire-mesh element comprises raised regions of the wire-mesh relief structure in which a polymeric material fills holes in the wire-mesh element.

* * * * *